United States Patent [19]

Kötter

[11] 4,436,114

[45] Mar. 13, 1984

[54] HYDRAULIC VALVE MECHANISM

[75] Inventor: Wolfgang Kötter, Markgröningen, Fed. Rep. of Germany

[73] Assignee: Robert Bosch GmbH, Stuttgart, Fed. Rep. of Germany

[21] Appl. No.: 301,185

[22] Filed: Sep. 11, 1981

[30] Foreign Application Priority Data

Sep. 16, 1980 [DE] Fed. Rep. of Germany ..... 3034859

[51] Int. Cl.[3] ..... F15B 13/04

[52] U.S. Cl. ..... 137/596; 60/427; 60/452; 91/446; 91/448

[58] Field of Search ..... 60/427, 452; 91/446, 91/448, 518; 137/596, 596.12, 596.13

[56] References Cited

U.S. PATENT DOCUMENTS

| | | | |
|---|---|---|---|
| 3,465,519 | 9/1969 | McAlvay et al. | 137/596.13 X |
| 3,534,774 | 10/1970 | Tennis | 137/596 |
| 3,602,104 | 8/1971 | Stremple | 137/596.13 X |
| 3,722,543 | 3/1973 | Tennis | 137/596.12 |
| 3,881,512 | 5/1975 | Wilke | 137/596.13 |
| 3,934,742 | 1/1976 | Tennis | 137/596.12 X |
| 4,037,410 | 7/1977 | Jackson et al. | 60/452 X |
| 4,352,375 | 10/1982 | Williams | 137/596.13 |

*Primary Examiner*—Gerald A. Michalsky
*Attorney, Agent, or Firm*—Michael J. Striker

[57] ABSTRACT

A hydraulic valve mechanism has a housing with first and second bores, a control valve element in the first bore, a pressure compensation valve in the second bore, and a non-return valve cooperating with motor parts, wherein control edges for direction control are arranged on the control valve element only at one side of throttle means, the non-return valve is also arranged in the second bore of the housing, and the longitudinal valve element of the pressure compensation valve also forms a closing member of the non-return valve.

9 Claims, 1 Drawing Figure

HYDRAULIC VALVE MECHANISM

BACKGROUND OF THE INVENTION

The present invention relates to hydraulic valve mechanisms.

Hydraulic valves are known and widely utilized.

One hydraulic valve is disclosed in the German Offenlegungsschrift No. 2,252,772, in which the functions of the pressure compensation of a pressure compensation valve are performed by a longitudinal valve element, whereas the functions of the throttle means and the direction control of the pressure medium stream to the motor ports are performed by a control valve element. For the functions of a load-maintaining non-return valve, a non-return valve separate from both the above-mentioned control elements is provided. Such a construction has the disadvantage that, for the above-mentioned four functions, three control elements are provided so that the valve is relatively expensive. In addition, the longitudinal axis of the non-return valve extends normal to the longitudinal axis of the control valve element so that the housing of the valve has a relatively great height. Moreover, in the known valve the control edges for the direction control are formed on the control valve element at both sides of the throttle means, which leads to the fact that downstream of the non-return valve for the pressure medium control to and from the motor ports, altogether six working chambers are necessary. This also increases the space consumption for the control valve. By the arrangement of the control edges for the direction control at both sides of the throttle means, the return chamber associated with the control valve element is arranged so far outwardly that a special return chamber must be provided for unloading of the control pressure medium in the region of the throttle means. Thereby, a compact construction of the valve in longitudinal direction of the control valve element is undesirably affected.

Further, a hydraulic valve is disclosed in the German Offenlegungsschrift No. 1,751,934 which is suitable for load-independent control. In this valve, the control edges for the direction control are arranged at one side of the throttle means on the control valve element; however, the throttle means here cooperate with a pressure compensating valve as bypass-flow control unit. This valve has the disadvantage that it does not have a non-return valve which protects the motor ports. In addition, this valve is poorly suitable for a parallel connection of several such valves.

SUMMARY OF THE INVENTION

Accordingly, it is an object of the present invention to provide a hydraulic valve mechanism which avoids the disadvantages of the prior art.

More particularly, it is an object of the present invention to provide a hydraulic valve mechanism which performs the same functions as known valves, but is less expensive than the latter.

In keeping with these objects, and with others which will become apparent hereinafter, one feature of the present invention resides, briefly stated, in a hydraulic valve mechanism having a housing, a control valve element in a first bore, a pressure compensating valve, and a non-return valve, wherein control edges for the direction control arranged on the control valve element are located only at one side of throttle means, the non-return valve is arranged in a second bore in which the pressure compensation valve is arranged, and a longitudinal valve element of the pressure compensation valve also forms a closing member of the non-return valve.

When the hydraulic valve mechanism is designed in accordance with the present invention, the required four functions are performed by only two control elements which not only simplify the construction of the valve mechanism, but also reduces the space consumption. The combination of the non-return valve with the pressure compensation valve in one axis provides for a considerably smaller housing of the valve mechanism. By performing the respective two functions to each valve element axis, the available space can be better utilized. The valve mechanism can be designed with five chambers for the direction control. The valve mechanism is better suited for parallel connection of several identical valve mechanisms.

In accordance with another advantageous feature of the present invention, the control valve element have control edges controlling communication from a chamber located downstream of the throttle means and upstream of the non-return valve, to the return chamber located near the motor chamber. In such a construction for unloading of the control pressure medium and for working pressure medium, the same return chamber can be utilized. This contributes to the compact construction of the valve mechanism.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
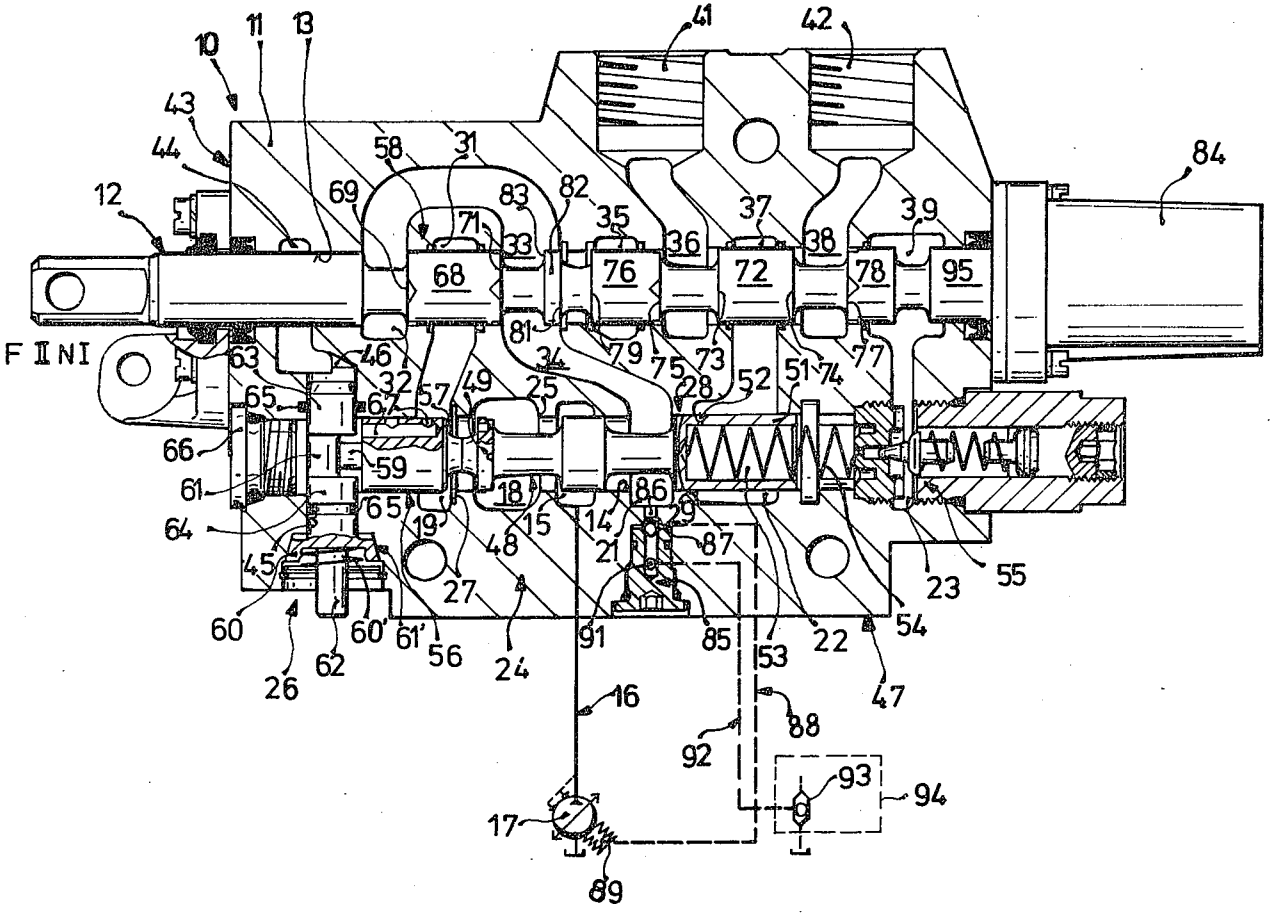
FIG. 1 is a view showing a hydraulic valve mechanism in accordance with the present invention.

A hydraulic valve mechanism in accordance with the present invention is identified by reference numeral 10.

The valve mechanism 10 has a housing 1 with a first bore 13 for a control valve element 12, and a second bore 14 extending parallel to the first bore. A plurality of ring-shaped extensions are provided in the longitudinal bore 14 and form a plurality of chambers. A feed chamber 15 is connected via a feed conduit 16 with an outlet of a variable-displacement pump 17. At one side of the feed chamber 15 adjacent to the latter, a first control chamber 18 and a second control chamber 19 are located. At the other side of the feed chamber 15 in the bore 14, a third control chamber 21, a supply chamber 22, and a discharge chamber 23 are located. In this manner, a first control edge 25 associated with a pressure compensation valve 24, a throttle edge 27 associated with a device 26 for maximum stream limiting, and a web 29 associated with a non-return valve 28 are provided in the housing 11.

Further chambers are formed by ring-shaped extensions of the bore 13, of which a central throttle chamber 31 directly communicates with the second control chamber 19 in the bore 14 and is surrounded by a left throttle chamber 32 and a right throttle chamber 33. Both outer throttle chambers 32 and 33 are connected with one another via a passage 34 and are connected with the third control chamber 21 in the bore 14. The portion in the region between the throttle chambers 32 and 33 is U-shaped.

Adjacent the right throttle chamber 33, a first return chamber 35, a first motor chamber 36, an inlet chamber 37 connected with the supply chamber 22, a second motor chamber 38, and a second return chamber 39 are arranged one after the other. The second return chamber 39 communicates with the discharge chamber 23, whereas the motor chambers 36 and 38 are connected with a first motor port 41 and second motor port 42. A third return chamber 44 is located in the bore 13 between the throttle chamber 32 and one operating side 43 of the housing 11. A pocket bore 45 extends with its end 46 into the third return chamber 44. The pocket bore 45 is introduced into the housing 11 from a bottom side 47 opposite to the motor ports 41, 42 and extends in the region between the operating side 43 and the second control chamber 19 transverse to the bore 14 so that their axes intersect each other.

A longitudinal valve element 48 is sealingly and slidingly guided in the bore 14 and forms a part of the pressure compensation valve 24 and also a part of the non-return valve 28. The longitudinal valve element 48 is provided for this purpose with a shoulder 49 which forms, together with a first control edge 25, a first throttle means associated with the pressure compensation valve, in pressure medium stream. Further, the longitudinal valve element 14 has at its right end a sleeve-shaped portion 51 which cooperates with the web 29 and forms a closing member of the non-return valve 28. A throttle opening 52 in the portion 51 connects the supply chamber 22 with a pressure space 53 which is limited by the portion 51 in the bore 14 and accommodates a spring 54 which loads the longitudinal valve element 48. For the functions of an upstream pressure-limiting valve, the pressure space 53 is secured by a pilot valve 55 to the discharge chamber 23. The spring 54 presses the longitudinal valve member 48 with its shoulder 49 against a throttle piston 56 which extends coaxial to the longitudinal valve element 48.

The throttle piston 56 has a throttle edge 57 cooperating with a throttle edge 27 in the housing 11 and together forming a third throttle means. This third throttle means 27, 57 is arranged in series to the first throttle means formed by the pressure compensation valve 24, and to the second throttle means 58 formed by the control valve element 12, and between these throttle means. The throttle piston 56 lies with its projection 59 on an eccentric 61 of a pin 62 supported in the pocket bore 45.

The eccentric 61 is formed in the pin 62 between cylindrical pin portions 63 and 64 of identical diameter.

In this region the bore 14 is sealed by sealing means 65 outwardly or to the third return chamber 44. For securing the pin 62 against unintentional rotation, it lies with a friction cone 60 loaded by a spring 60' in a conical extension 61' of the pocket bore 44. A locking screw 66 closes the bore 14 at the operating side 43. In order to provide pressure compensation of the throttle piston 46, radial and axial bores 67 are arranged in its interior.

In the region of the throttle means 58, a first control edge 69 and a second control edge 71 are provided on a piston portion 68 of the control valve element 12. They control the communication between the central throttle chamber 31 to the left throttle chamber 32 and the right throttle chamber 33. Further, a third control edge 73 and a fourth control edge 74 are provided on a piston portion 72 facing toward the inlet chamber 37, and influence the pressure medium stream flowing to the motor ports 41, 42. A fifth control edge 75 on a piston portion 76 controls the connection from the first motor port 41 to the first return chamber 35. A sixth control edge 77 on a piston portion 78 controls the connection from the second motor port 42 to the second return chamber 39.

The third, fourth, fifth and sixth control edges 73, 74, 75 and 77 serve for direction control of the pressure medium stream to or back from the motor ports 41 and 42. On the piston portion 76, a seventh control edge 79 is formed which operates for the connection between the right throttle chamber 33 and the first return chamber 35. The latter mentioned connection is also associated with an eighth control edge 81 which is formed on a piston portion 82 between the piston portions 68 and 76. The same piston portion 82 carries a ninth control edge 83 which in a free-floating position of the control valve element blocks the connection from the central throttle chamber 31 to the left throttle chamber 32. At the side of the side of the housing, which is opposite to the operating side 43, a double-acting arresting and return device 84 for the control valve element 12 is provided.

An alternator valve 85 is arranged in the housing 11 and connected by its one side port 86 with the third control chamber 21. A first control conduit 88 extends from its central port 87 to a regulator 89 of the pump 17. A second control conduit 92 extends from its other side port 91 to a central port of a second alternator valve 93 which is arranged in a second valve mechanism 94 connected in parallel with the valve mechanism 10. The second valve mechanism 94 is formed as the first valve mechanism 10 and its other side port on the alternator valve 93 is unloaded to a tank when the second valve mechanism 94 is the last one in a row of connected-in-parallel valve mechanisms.

The operation of the valve mechanism 10 is performed in the following manner:

In the shown neutral position of the control valve element 12, the connection from the supply conduit 16 via the pressure compensation valve 24 and the throttle means 58 to the passage 34 is blocked. The regulator 89 on the variable-displacement pump 17 is unloaded via the first control conduit 88, the alternator valve 85, the passage 34, and the eighth control edge 81, to the first return chamber 35. The pressure at the outlet of the pump 17 is limited to an initial pressure. In the neutral position of the valve mechanism 10 and simultaneous parallel operation of the valve mechanism 94, the alternator valve 85 prevents control oil losses via the second control conduit 92.

When the control valve element 12 is displaced from the shown neutral position to the right in a first working position, the eighth control edge 81 closes first the unloading of the passage 34 to the first return chamber 35. After this, the sixth control edge 77 opens the connection from the second motor port 42 to the second return chamber 39. Finally, the third control edge 73 opens the connection from the first motor port 41 to the supply chamber 22, so that the load pressure acting in the latter can build via the throttle opening 52 in the pressure space 53 and hold the non-return valve 28 closed. The first control edge 69 in the throttle means 58 produces a connection from the central throttle chamber 31 via the left throttle chamber 32 and the passage 34 to the third control chamber 21, whereby the pressure formed from the pump 16 can act via the above-mentioned connection, the alternator valve 85 and the first control conduit 88 in the regulator 89. In the regulator 89 of the pump 17, pressure compensation takes place and a return spring of the regulator takes care of the swinging of the pump 17. Thereby, the pressure in the feed conduit 16 increases, and also increases the pressure in the third control chamber 21, depending therefrom, via the load pressure in the pressure chamber 53 so as to open the return valve 28. This control sequence guarantees that all control edges 69, 73 or throttle means 49, 25 in the pressure medium stream flowing from the pump 17 to the motor port 41 are controlled when the pump 17 rotates. The non-return valve 28 prevents lowering of the load at the motor port 41 because of the flowing out pressure medium via the control circuit. With the aid of the pressure compensation valve 24, the pressure flow via the orifice controlled by the first control edge 69 remains in constant regardless of the pump pressure or the load pressure. The pressure upstream of the throttle means 58 acts upon the end face of the shoulder 49, whereas the pressure downstream of the throttle means 58 acts together with the force of the spring 54 in the pressure space 53 onto the longitudinal valve element 48. This pressure in the pressure space 53 corresponds to the respective load pressure in the directly connected motor port 41. The pressure differential via the orifice controlled by the control edge 69 is determined by the force of the spring 54. The pressure resulting from the spring 54 must be smaller than the initial pressure of the pump 17. The dimension of the pressure medium stream flowing from the pump 17 to the first motor port 41 can thereby be adjusted proportionally to displacement of the control valve element 12, independent of the variations of the pump pressure or the load pressure. The first switch position extends thereby via a predetermined stroke region of the control valve element 12. The control valve element 12 and the longitudinal valve element 48 perform thereby, in the event of the pressure medium stream flowing to the motor port 41, two functions in advantageous manner, whereas the control valve element 12 performs the function of the throttle and the direction control, and the longitudinal valve element 48 performs the function of a pressure balance and the return valve.

When the control valve element 12 is displaced from the shown neutral position to a second switch position, the seventh control edge 79 controls in a reverse manner its associated connection, whereafter the fourth control edge 74 and the fifth control edge 75 for the direction control controls the connection from the inlet chamber 37 to the second motor port 42 and from the first motor port 41 to the first return chamber 35. After this, in the throttle means 58, the second control edge 71 releases the connection from the central throttle chamber 31 to the right throttle chamber 33. Thereby, the pressure medium stream from the pump 17 to the second motor port 42 can be controlled in the manner corresponding to that of the switch position I proportional to the magnitude of the displacement of the control valve element 12. Simultaneously, the first motor port 41 is unloaded to the return chamber 35.

When the control valve element 12 is further displaced to the left over the region of the switch position II, it can assume a free-floating position. In this free-floating position, the piston portion 78 is located inside the inlet chamber 37 so that the first motor port 41 is connected with the second motor port 42 via the first motor chamber 36, the inlet chamber 37, and the second motor chamber 38. The connection from the motor ports 41 and 42 to the return chambers 35 and 39 is blocked by the piston portions 72 and 95. The central throttle chamber 31 is separated by the piston portions 82 and 76 from the outer throttle chambers 32 and 33. Simultaneously, the fifth control edge 75 on the piston portion 76 controls a connection from the passage 34 to the first return chamber 35, so that the first control conduit 88 leading to the regulator 89 is unloaded and the pump 17 provides for a supply with the initial pressure. In addition, the control valve element 12 is arrested by the arresting and return device 84, which is also the case in the switching positions I and II in the event of the maximum displacement of the control valve element 12.

In order to limit the magnitude of the pressure medium stream flowing to the motor ports 41 and 42 in the switch positions I and II, a device for maximum stream limiting 26 is provided. It forms an adjustable throttle means 27, 67 between the pressure the pressure compensation valve 24 and the throttle means 58. It acts in the event that the flow cross section controlled by the control edges 69, 71 is greater than the cross section released by the throttle piston 56. The pressure upstream and downstream of the third throttle means 27, 57 acts against the force of the spring 54 onto the longitudinal valve element 48 so that a further stream regulation is obtained. The pressure downstream of the third throttle means 27, 57 is forwarded via the radial and axial bores 67 in the pressure piston 56 to its other side, so that the pressure piston 56 is continuously pressure-equalized and abuts with its projection 59 against the eccentric 61 with a small force. The pin 62 is adjustable within an adjustment angle smaller than 180°, whereby the flow cross section of the third throttle means 27, 57 can be changed. Since the piston 62 is pressure-compensated against the pressure in the second control chamber 19 and a return pressure acts against the end side of the pin portion 63, the control valve element can be actuated in the first and second switch positions. An undesirable rotation of the pin 62 is prevented by a brake in such a manner that the spring 60' abutting against a part fixedly connected with the housing presses a friction cone 16 into a complementary conical extension of the pocket bore 45.

For pressure-limiting, the pilot valve 55 and the longitudinal valve element 48 cooperate with one another as a controlled pressure-limiting valve so as to limit the primary pressure in the feed conduit 16. Thus, the longitudinal valve element 48 operates as a main stage, whereas the shoulder 49 throttles or blocks with the first control edge 26 the inflowing pressure medium stream.

In the event of the parallel operation of both valve mechanisms 10 and 94, the pressure at the outlet of the pump 17 corresponds to the highest load pressure which is forwarded via the alternator valve 85 or 93 to the regulator 89.

It is to be understood that modifications of the construction are possible. Instead of the provision of the throttle means with three chambers, a construction with two chambers is possible as known in the conventional valve mechanisms. A particularly favorable utilization of the available space can be attained when the device 26 and the pilot valve 55 are associated with the axis of the pressure compensation valve and the non-return valve so as to perform the functions of a maximum stream limiting as well as a primary pressure limiting.

It will be understood that each of the elements described above, or two or more together, may also find a useful application in other types of constructions differing from the types described above.

While the invention has been illustrated and described as embodied in a valve mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic valve mechanism, comprising a housing having a first bore and a second bore; a control valve element in said first bore and having control edges for direction control and arranged so as to selectively connect motor ports in an operative position with fluid feed and return means and to block the same in a neutral position, and control edges arranged for forming throttle means; a pressure compensation valve upstream of said throttle means and having a longitudinal valve element in said second bore and allowing with said throttle means load independent flow control; and a non-return valve downstream of said throttle means and cooperating with the motor ports, said control edges for direction control being arranged on said control valve element only at one side of said throttle means, said non-return valve being also arranged in said second bore of said housing, and said longitudinal valve element also forming a closing member of said non-return valve.

2. A hydraulic valve mechanism as defined in claim 1, wherein said housing has a first chamber located downstream of said throttle means and upstream of said non-return valve, a motor chamber, and a return chamber located near said motor chamber, said control valve element having control edges controlling communication from said first chamber to said return chamber located near said motor chamber.

3. A hydraulic valve mechanism as defined in claim 2, wherein said housing has a third control chamber formed in said second bore, and a passage arranged downstream of said throttle means and leading to said third control chamber.

4. A hydraulic valve mechanism as defined in claim 3, wherein said housing has an inlet chamber communicating with said first bore, and a supply chamber communicating with said inlet chamber, said third control chamber which is connected with said passage being arranged near said supply chamber, said housing having a web located between said third control chamber and said supply chamber and forming together with a portion of said longitudinal valve element said non-return valve.

5. A hydraulic valve mechanism as defined in claim 4; and further comprising an alternator valve arranged in said housing and having a side port connected with said passage.

6. A hydraulic valve mechanism as defined in claim 1, wherein said pressure compensating valve forms throttle means, said longitudinal valve element having a pressure space and a spring in said pressure space and arranged for loading said longitudinal valve element in direction to its inoperative position in which said non-return valve is closed and said throttle means formed by said pressure compensating valve is controlled.

7. A hydraulic valve mechanism as defined in claim 1, wherein said housing has a first control chamber, a feed chamber, and a housing side to which said throttle means is closer, said first control chamber being located between said feed chamber and said housing side.

8. A hydraulic valve mechanism as defined in claim 1, wherein said longitudinal valve element has an axis and two axial sides; and further comprising means for maximum stream limiting arranged at one axial side of said longitudinal valve element, and a pilot valve for primary pressure limiting arranged at the other axial end of said longitudinal valve element.

9. A hydraulic valve mechanism, comprising a housing having a first bore and a second bore and a supply chamber; a control valve element in said first bore and having control edges for direction control and arranged so as to selectively connect motor ports in an operative position with fluid feed and return means and to block the same in a neutral position, and control edges arranged for forming throttle means; a pressure compensation valve upstream of said throttle means and having a longitudinal valve element in said second bore and allowing with said throttle means load independent flow control, said pressure compensating valve forming throttle means; and a non-return valve downstream of said throttle means and cooperating with the motor ports, said control edges for direction control being arranged on said control valve element only at one side of said throttle means, said non-return valve being also arranged in said second bore of said housing, and said longitudinal valve element also forming a closing member, of said non-return valve, said longitudinal valve element having a pressure space and a spring in said pressure space and arranged for loading said longitudinal valve element in direction to its inoperative position in which said non-return valve is closed and said throttle means formed by said pressure compensating valve is controlled, said longitudinal valve element having a piston portion with a throttle opening, said pressure space communicating via said throttle opening with said supply chamber; and a pilot valve associated with the same.

* * * * *